US007377755B2

(12) United States Patent
Cho

(10) Patent No.: US 7,377,755 B2
(45) Date of Patent: May 27, 2008

(54) MULTI-STAGE ROTARY COMPRESSOR

(75) Inventor: Sung Oug Cho, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 415 days.

(21) Appl. No.: 11/187,882

(22) Filed: Jul. 25, 2005

(65) Prior Publication Data

US 2006/0159566 A1 Jul. 20, 2006

(30) Foreign Application Priority Data

Jan. 18, 2005 (KR) ..... 10-2005-0004716

(51) Int. Cl.

| | |
|---|---|
| ***F04B 49/00*** | (2006.01) |
| ***F04B 3/00*** | (2006.01) |
| ***F04B 35/04*** | (2006.01) |
| ***F01M 11/02*** | (2006.01) |

(52) U.S. Cl. ..... 417/310; 417/251; 417/252; 417/253; 417/279; 417/307; 417/410.3; 184/6.16; 418/11

(58) Field of Classification Search ..... 417/410.3, 417/307, 279, 251, 310, 253, 902, 252; 184/6.16; 418/11

See application file for complete search history.

(56) References Cited

U.S. PATENT DOCUMENTS

| | | | | |
|---|---|---|---|---|
| 6,533,558 | B1 * | 3/2003 | Matsumoto et al. | 417/410.3 |
| 2004/0001762 | A1 * | 1/2004 | Matumoto et al. | 417/244 |
| 2004/0208769 | A1 | 10/2004 | Sato et al. | |

FOREIGN PATENT DOCUMENTS

| | | |
|---|---|---|
| CN | 1532420 A | 9/2004 |
| JP | 02-140477 | 5/1990 |
| JP | 05-133367 | 5/1993 |
| JP | 2002-242834 | 8/2002 |
| JP | 2003-166488 | 6/2003 |
| JP | 2003-172280 | 6/2003 |
| JP | 2004-19599 | 1/2004 |

OTHER PUBLICATIONS

The First Office Action dated Oct. 19, 2007 issued by the State Intellectual Property Office of P.R. China in the corresponding Chinese Application No. 2005100877688 (5 pages) with an English language translation (6 pages).

Official Action dated Oct. 19, 2007 issued by the Japanese Patent Office in the corresponding Japanese Application No. 2005-243245 (3 pages).

* cited by examiner

*Primary Examiner*—David J. Isabella
*Assistant Examiner*—Rocco Italiano
(74) *Attorney, Agent, or Firm*—Staas & Halsey LLP

(57) ABSTRACT

A multi-stage rotary compressor to reduce a driving load and prevent a malfunction due to an abrupt pressure rising. In the compressor of the type including first and second compressing units mounted in a hermetic casing thereof to compress a gas, the gas being primarily compressed in the first compressing unit and secondarily compressed in the second compressing unit, the interior of the hermetic casing is divided into a plurality of spaces including first and second pressure chambers. The first pressure chamber surrounds the first compressing unit and is kept at a discharge pressure of the first compressing unit, and the second pressure chamber surrounds the second compressing unit and is kept at a discharge pressure of the second compressing unit.

7 Claims, 4 Drawing Sheets

MULTI-STAGE ROTARY COMPRESSOR

CROSS-REFERENCE TO RELATED APPLICATIONS

This application claims the benefit of Korean Patent Application No. 2005-4716, filed on Jan. 18, 2005 in the Korean Intellectual Property Office, the disclosure of which is incorporated herein by reference.

BACKGROUND OF THE INVENTION

1. Field of the Invention

The present invention relates to a multi-stage rotary compressor, and more particularly, to a multi-stage rotary compressor to reduce a driving load and prevent a malfunction incurred by a steep pressure rising.

2. Description of the Related Art

A multi-stage rotary compressor, as disclosed in Japanese Patent Publication No. 2004-19599 (published on Jan. 22, 2004), includes a lower first compression chamber and an upper second compression chamber. In operation, a refrigerant gas is primarily compressed in the first compression chamber to an intermediate pressure, and secondarily compressed in the second compression chamber to a higher pressure while successively passing through the first and second compression chambers, thereby being discharged into a hermetic casing of the compressor in a substantially high pressure state.

The rotary compressor further includes first and second rollers that eccentrically rotate in the respective compression chambers, first and second vanes each serving to sectionalize an associated one of the compression chambers into a suction space and a discharge space while reciprocating in a radial direction of the associated compression chamber according to a rotation of the first or second roller, and first and second vane springs to press the vanes toward the rollers.

By virtue of the elasticity of the vane springs and the high interior pressure of the hermetic casing, the first and second vanes are kept in close contact with outer circumferences of the first and second rollers, respectively, when they are pressed inward in the respective compression chambers to compress a refrigerant.

However, the above described multi-stage rotary compressor experiences a pressure difference between the interior of the first compression chamber and the interior of the hermetic casing because, during a compression operation, the second compression chamber and the hermetic casing are kept at high interior pressures, whereas the first compression chamber is kept at an intermediate interior pressure below the interior pressure of the hermetic casing. The pressure difference causes the first vane to press the outer circumference of the first roller with an unnecessarily large force, resulting in an increased driving load.

Thereby, although the second vane presses the second roller with a moderate force because there exists no noticeable pressure difference between the second compression chamber and the hermetic casing, the substantial pressure difference between the first compression chamber and the hermetic casing problematically increases a press force of the first vane against the outer circumference of the first roller, resulting in much frictional wear between the first vane and the first roller. Further, the increased driving load incurs a loss of energy.

Another problem of the multi-stage rotary compressor is that the interior pressure of the first compression chamber rises abruptly (i.e. above the intermediate pressure) if a refrigerant liquid is introduced into the first compression chamber during an initial operation. Because the refrigerant, passed by the first compression chamber, is again compressed in the second compression chamber rather than discharged directly into the hermetic casing, the abrupt pressure rising generates an overload in the compressor, hindering a smooth starting thereof.

SUMMARY OF THE INVENTION

The present invention has been made in order to solve the above problems. It is an aspect of the invention to provide a multi-stage rotary compressor that reduces a pressure difference between the interior of a first compression chamber and a space around the first compression chamber to achieve a reduced friction incurred by a first vane, thus resulting in a negligible driving load.

It is a further aspect of the invention to provide a multi-stage rotary compressor that eliminates the risk of an abrupt pressure rising in a first compression chamber, thereby preventing a malfunction of the compressor.

Additional aspects and/or advantages of the invention will be set forth in part in the description which follows and, in part, will be apparent from the description, or may be learned by practice of the invention.

Consistent with one aspect, an exemplary embodiment of the present invention provides a multi-stage rotary compressor including first and second compressing units mounted in a hermetic casing to compress a gas, the gas being primarily compressed in the first compressing unit and secondarily compressed in the second compressing unit, wherein the interior of the hermetic casing is divided into a plurality of spaces including first and second pressure chambers, the first pressure chamber surrounding the first compressing unit and being kept at a discharge pressure of the first compressing unit, the second pressure chamber surrounding the second compressing unit and being kept at a discharge pressure of the second compressing unit.

The first compressing unit may include a first cylinder body defining a first compression chamber, a first roller that eccentrically rotates in the first compression chamber to compress the gas, and a first vane that reciprocates in a radial direction of the first compression chamber according to a rotation of the first roller to divide the interior of the first compression chamber into a suction space and a discharge space, and the second compressing unit may include a second cylinder body defining a second compression chamber, a second roller that eccentrically rotates in the second compression chamber to compress the gas, and a second vane that reciprocates in a radial direction of the second compression chamber according to a rotation of the second roller to divide the interior of the second compression chamber into a suction space and a discharge space.

The first compressing unit may be located below the second compressing unit, and the compressor may further include a first partition interposed between the first cylinder body and the second cylinder body in order to separate the first and second compression chambers from each other and to divide the interior of the hermetic casing into the first and second pressure chambers, and a second partition disposed under the first compressing unit in order to divide the interior of the hermetic casing into the first pressure chamber and an oil sump under the first pressure chamber.

The compressor may further include a pressure adjustment channel formed through the first partition in order to communicate the first pressure chamber with the second pressure chamber, and a pressure adjustment valve provided at the pressure adjustment channel to open the pressure adjustment channel when a pressure of the first pressure chamber is more than a preset pressure to allow the gas to flow from the first pressure chamber to the second pressure chamber and to close the pressure adjustment channel when the pressure of the first pressure chamber is less than the preset pressure.

The pressure adjustment valve may be a reed valve to close an outlet of the pressure adjustment channel at the side of the second pressure chamber.

The compressor may further include a pressure adjustment channel between the first and second pressure chambers for the communication therebetween, and a pressure adjustment valve to open the pressure adjustment channel when a pressure of the first pressure chamber is more than a preset pressure to allow the gas to flow from the first pressure chamber to the second pressure chamber and to close the pressure adjustment channel when the pressure of the first pressure chamber is less than the preset pressure.

The first vane may be exposed to the first pressure chamber to be pressed by the pressure of the first pressure chamber, and the second vane may be exposed to the second pressure chamber to be pressed by the pressure of the second pressure chamber.

The oil sump may communicate with the second pressure chamber via a channel to keep the same pressure as that of the second pressure chamber.

The compressor may further include a connection pipe provided at the outside of the hermetic casing to deliver the gas from the first pressure chamber to a suction port of the second compressing unit.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
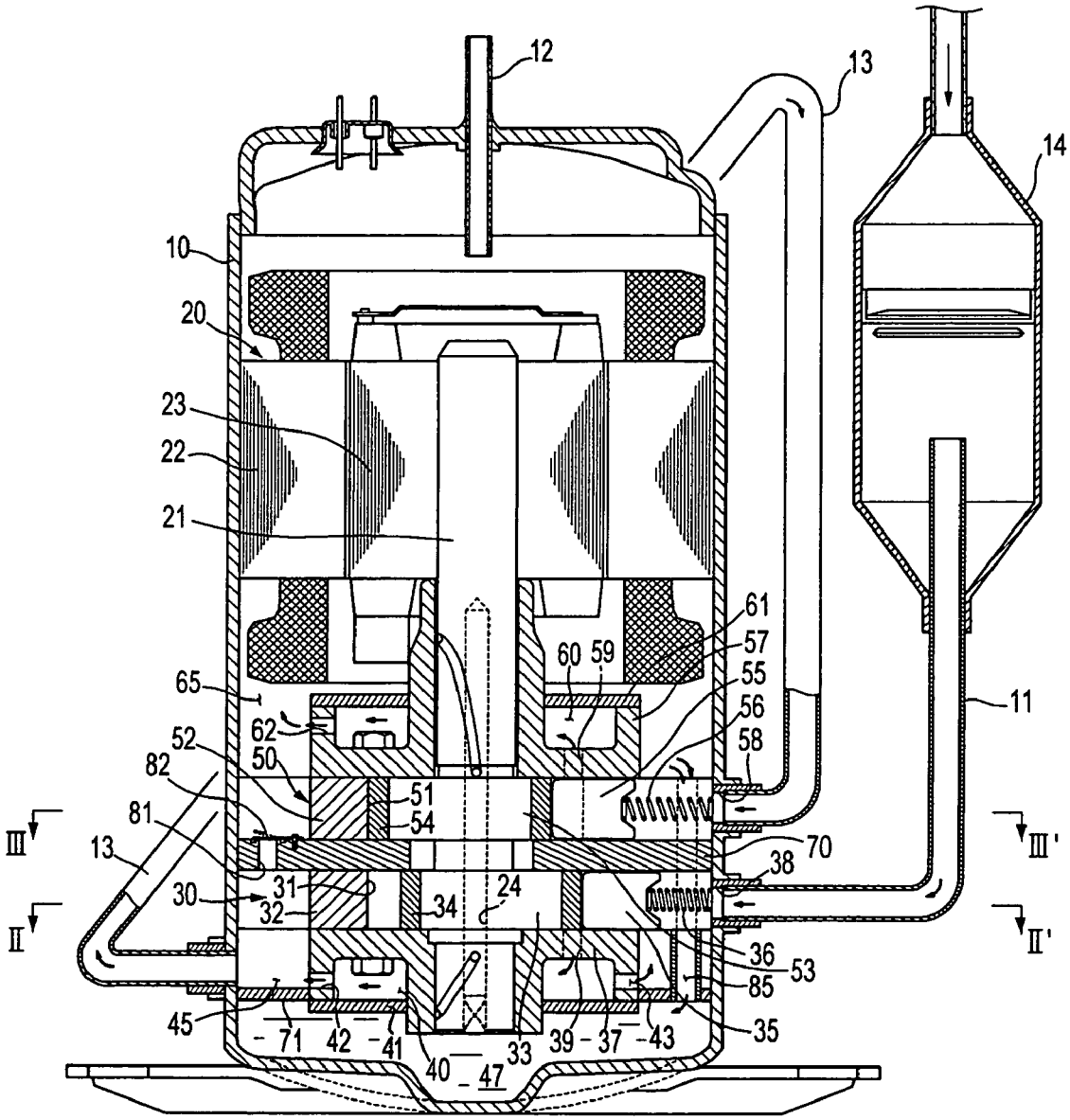
FIG. 1 is a vertical sectional view of a multi-stage rotary compressor consistent with an exemplary embodiment of the present invention.

Reference will now be made in detail to an exemplary embodiment of the present invention, an example of which is illustrated in the accompanying drawings, wherein like reference numerals refer to like elements throughout. The embodiment is described below to explain the present invention by referring to the figures.

FIG. 1 is a vertical sectional view of a multi-stage rotary compressor consistent with an exemplary embodiment of the present invention. As shown in FIG. 1, the multi-stage rotary compressor of the present invention includes a hermetic casing 10, a motor driving device 20 mounted in the upper portion of the hermetic casing 10 to generate a rotary force, and a refrigerant compressing device mounted in the lower portion of the hermetic casing 10 and connected to the motor driving device 20 via a rotary shaft 21.

The motor driving device 20 includes a cylindrical stator 22 fixed on an inner circumference of the hermetic casing 10, and a rotor 23 rotatably disposed in the stator 22 and coupled to the rotary shaft 21 at a hollow center portion thereof.

The compressing device includes a first compressing unit 30 and a second compressing unit 50 located above the first compressing unit 30. The first compressing unit 30 primarily compresses a suction refrigerant, and the second compressing unit 50 secondarily compresses the compressed refrigerant from the first compressing unit 50 to a higher pressure than that at the first compressing unit 30.

Figure 2:
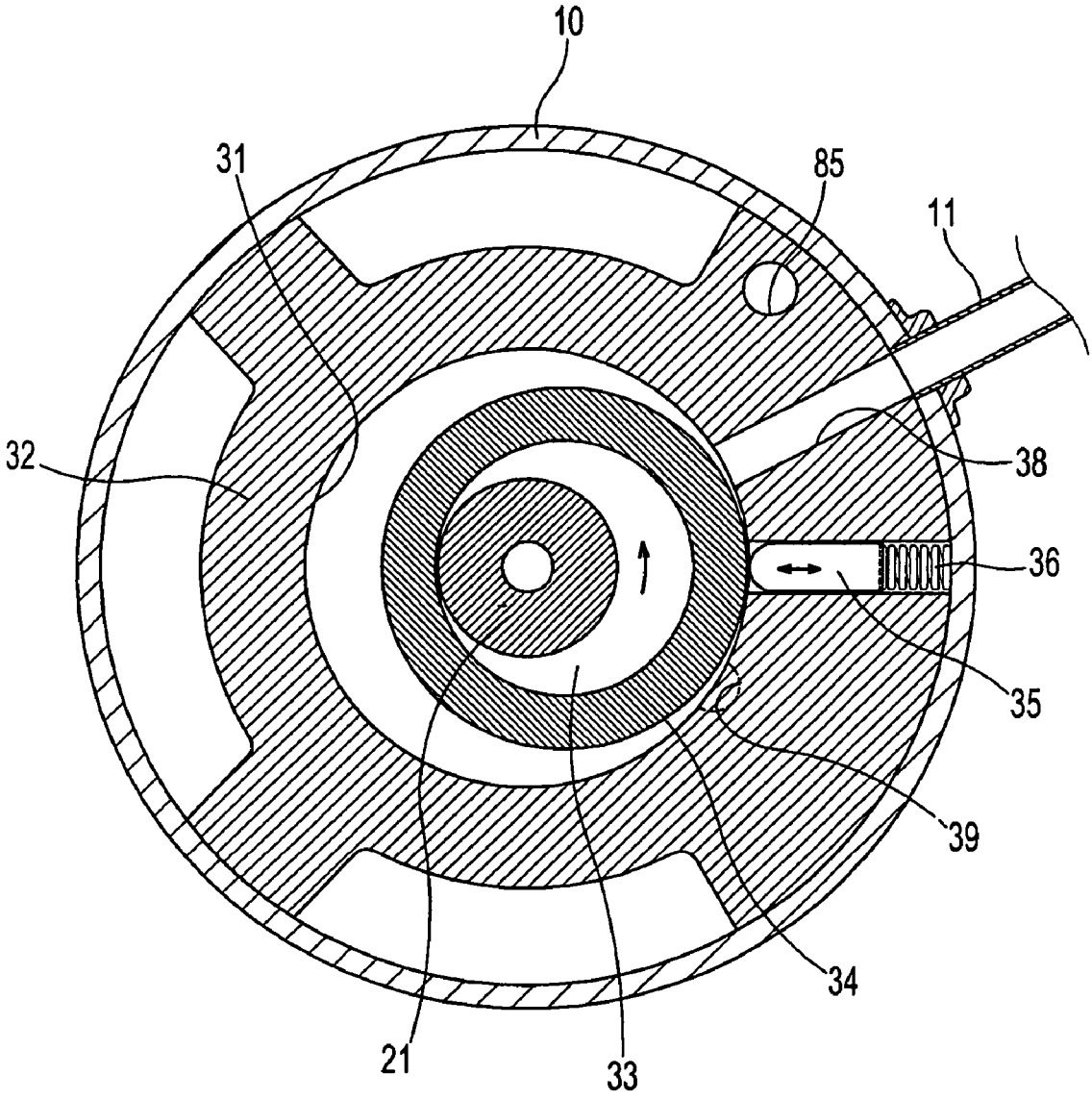
FIG. 2 is a cross sectional view taken along the line II-II' of FIG. 1.

FIG. 2 is a cross sectional view taken along the line II-II' of FIG. 1.

Referring to FIGS. 1 and 2, the first compressing unit 30 includes a first cylinder body 32 defining a cylindrical first compression chamber 31, and a first eccentric portion 33 provided around the rotary shaft 21 in the first compression chamber 31. In addition, a first roller 34 is rotatably coupled to an outer circumference of the first eccentric portion 33 to eccentrically rotate while coming into partial contact at an outer circumference thereof with an inner circumference of the first cylinder body 32 defining the first compression chamber 31. According to such eccentric rotation of the first roller 34, a first vane 35 reciprocates in a radial direction of the first compression chamber 31 to sectionalize the interior space of the first compression chamber 31 into a suction space and a discharge space. A first vane spring 36 presses the first vane 35 toward the first roller 34.

The first compressing unit 30 further includes a first support member 37 attached to a lower surface of the first cylinder body 32 to close an opened lower end of the first compression chamber 31 and rotatably support the rotary shaft 21. The first cylinder body 32 has a first suction port 38 for the connection of a refrigerant suction pipe 11, and the first support member 37 has a first discharge port 39 for the discharge of the refrigerant compressed in the first compression chamber 31. The first suction port 38 and the first discharge port 39 are located at opposite sides of the first vane 35. The first support member 37 has a first discharge chamber 40 provided in a lower region thereof to attenuate a noise and pulsation of the compressed refrigerant gas discharged via the first discharge port 39. A first cover 41 closes an opened lower end of the first discharge chamber 40. The first support member 37 further has a plurality of lateral through-holes 42 and 43 to communicate the first discharge chamber 40 with the interior of the hermetic casing 10.

Figure 3:
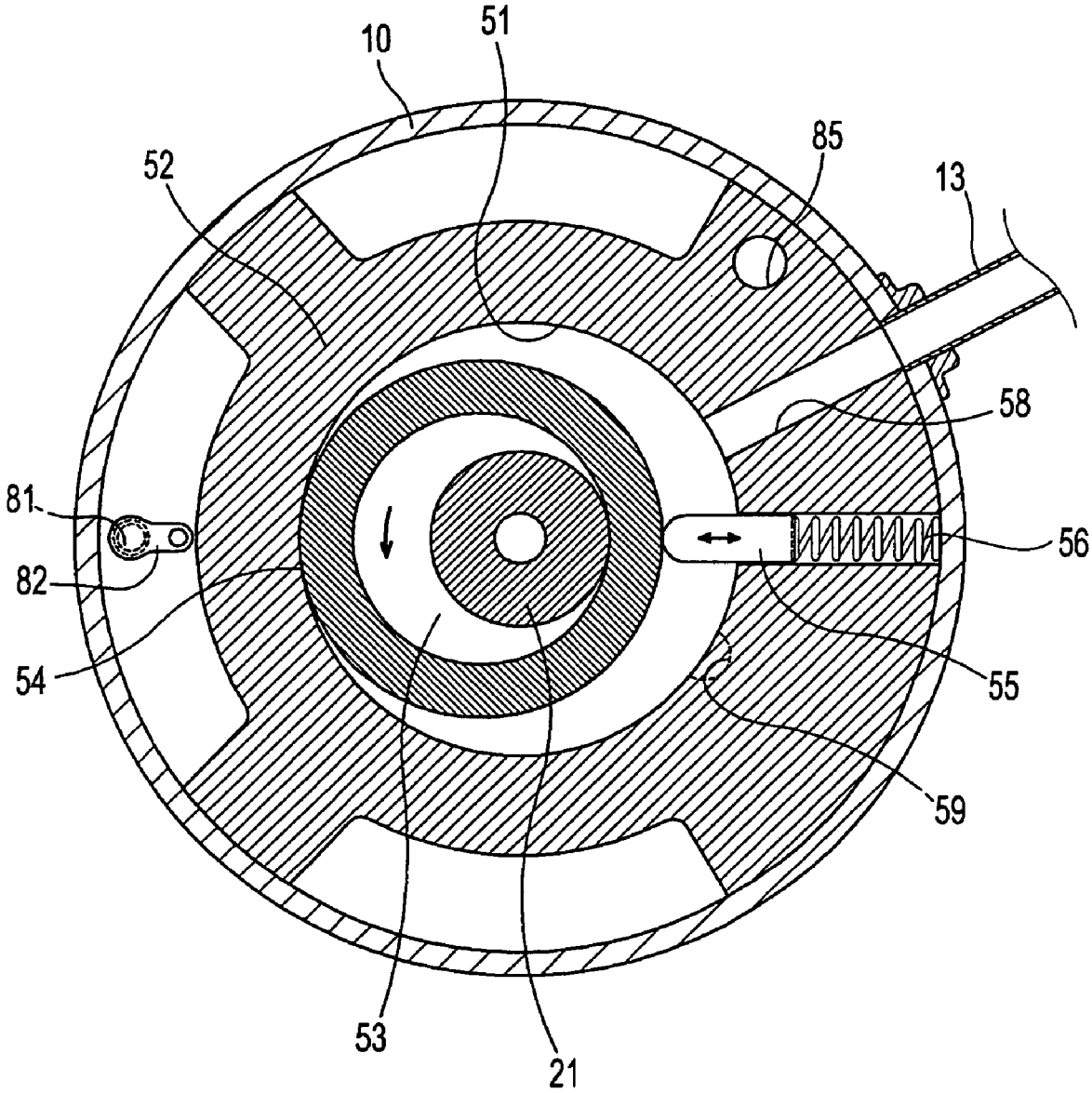
FIG. 3 is a cross sectional view taken along the line III-III' of FIG. 1.

FIG. 3 is a cross sectional view taken along the line III-III' of FIG. 1.

Referring to both FIGS. 1 and 3, the second compressing unit 50 includes a second cylinder body 52 defining a cylindrical second compression chamber 51, and a second eccentric portion 53 provided around the rotary shaft 21 in the second compression chamber 51. The second eccentric portion 53 has a phase angle of 180° with the first eccentric portion 33. In addition, a second roller 54 is rotatably coupled to an outer circumference of the second eccentric portion 53 to eccentrically rotate while coming into partial contact at an outer circumference thereof with an inner circumference of the second cylinder body 52 defining the second compression chamber 51. According to such eccentric rotation of the second roller 54, a second vane 55 reciprocates in a radial direction of the second compression chamber 51 to sectionalize the interior space of the second compression chamber 51 into a suction space and a discharge space. A second vane spring 56 presses the second vane 55 toward the second roller 54.

The second compressing unit 50 further includes a second support member 57 attached to an upper surface of the second cylinder body 52 to close an opened upper end of the second compression chamber 51 and rotatably support the rotary shaft 21. The second cylinder body 52 has a second suction port 58, and the second support member 57 has a second discharge port 59 for the discharge of the refrigerant compressed in the second compression chamber 51. The second suction port 58 and the second discharge port 59 are located at opposite sides of the second vane 55. The second support member 57 has a second discharge chamber 60 provided in an upper region thereof to attenuate a noise and pulsation of the compressed refrigerant gas discharged via the second discharge port 59. A second cover 61 closes an opened upper end of the second discharge chamber 60. The second support member 57 further has a lateral hole 62 to communicate the second discharge chamber 60 with the interior of the hermetic casing 10.

The first and second compressing units 30 and 50 are separated from each other by interposing a disk-shaped first partition 70 between the first and second cylinder bodies 32 and 52. This means that the first compression chamber 31 is separated from the second compression chamber 51. The disk-shaped first partition 70 is sized so that an outer periphery thereof comes into close contact with the inner circumference of the hermetic casing 10 in an air-tight manner, thereby dividing the interior space of the hermetic casing 10 into a lower first pressure chamber 45 and an upper second pressure chamber 65. The first pressure chamber 45 is separated from an oil sump 47 therebelow by means of a ring-shaped second partition 71 that is inserted between an outer circumference of the first support member 37 and the inner circumference of the hermetic casing 10. A connection pipe 13 is provided at the outside of the hermetic casing 10 to communicate the first pressure chamber 45 with the second suction port 58, thereby enabling the refrigerant gas of the first pressure chamber 45, compressed through the first compressing unit 30, to be supplied to the second suction port 58 of the second compressing unit 50. Also shown in FIG. 1 is a discharge pipe 12 to finally discharge the high-pressure refrigerant gas within the second pressure chamber 65 to the outside, and an accumulator 14 installed at the refrigerant suction pipe 11.

The above described configuration is intended to supply the refrigerant gas, which is primarily compressed in the first compressing unit 30, to the second compressing unit 50 via the connection pipe 13 such that it is secondarily compressed to a higher pressure, and also intended to enable the high-pressure refrigerant gas, discharged from the second compressing unit 50 into the second pressure chamber 65, to be discharged from the discharge pipe 12 provided at an upper surface of the hermetic casing 10. Thereby, the first pressure chamber 45 around the first compressing unit 30 is kept at a discharge pressure of the first compressing unit 30, and the second pressure chamber 65 around the second compressing unit 50 is kept at a discharge pressure of the second compressing unit 50 that is higher than the discharge pressure of the first pressure chamber 45. Furthermore, the above described configuration is intended to exert the pressure of the first pressure chamber 45 on the first vane 35 and the pressure of the second pressure chamber 65 on the second vane 55. For this, each of the first and second vanes 35 and 55 is exposed at an end thereof facing the inner circumference of the hermetic casing 10 to the first pressure chamber 45 or second pressure chamber 65 to communicate with it. This is to substantially equalize the pressure of the first compression chamber 31 with the pressure of the first pressure chamber 45 outside the first compressing unit 30 to thereby prevent the first vane 35 from excessively pressing the outer circumference of the first roller 34 as well as substantially equalize the pressure of the second compression chamber 51 with the pressure of the second pressure chamber 65 outside the second compressing unit 50 to thereby prevent the second vane 55 from excessively pressing the outer circumference of the second roller 54.

Figure 4:
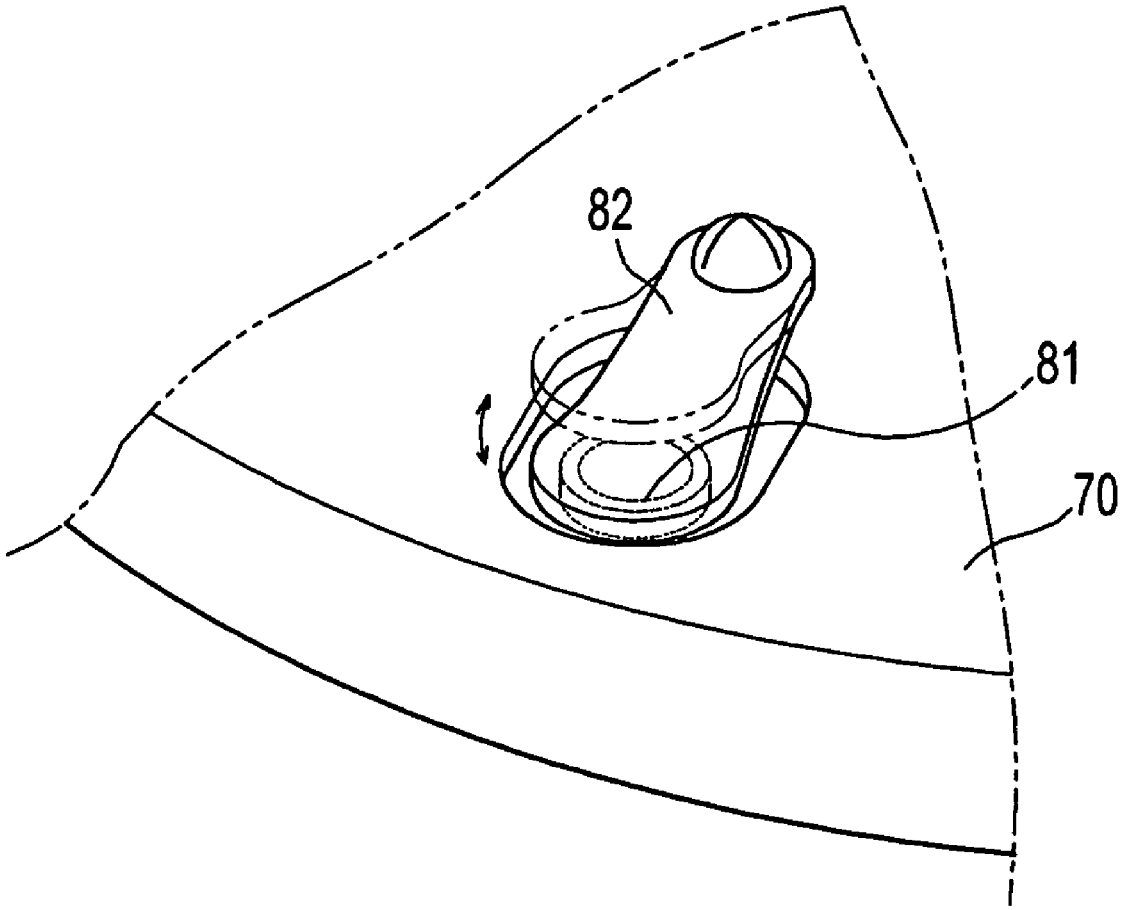
FIG. 4 is a perspective view of a pressure adjustment valve provided in the multi-stage rotary compressor of FIG. 1.

Referring to FIGS. 1 and 3 again, the first partition 70 has a pressure adjustment channel 81 to communicate the first pressure chamber 45 with the second pressure chamber 65. Such a pressure adjustment channel 81 allows a refrigerant gas to flow from the first pressure chamber 45 into the second pressure chamber 65 if the pressure of the first pressure chamber 45 rises above a preset pressure in an initial starting. The pressure adjustment channel 81 is provided with a pressure adjustment valve 82 that opens the pressure adjustment channel 81 when the pressure of the first pressure chamber 45 is more than the preset pressure and closes the pressure adjustment channel 81 when the pressure of the first pressure chamber 45 is less than the preset pressure. Referring to FIG. 4, the pressure adjustment valve 82 is formed as a conventional reed valve that selectively opens an outlet of the pressure adjustment channel 81 at the side of the second pressure chamber 65 only when desired. Based on the elasticity of the pressure adjustment valve 82, the preset pressure of the first pressure chamber 45 is determined. This is to allow the pressure adjustment valve 82 to perform an opening operation only under the influence of the pressure of the first pressure chamber 45, thereby ensuring only one-way passage of the refrigerant gas from the first pressure chamber 45 to the second pressure chamber 65.

With the pressure adjustment means of the present invention as described above, when the pressure of the first compressing chamber 31 rises abruptly above the pressure of the second pressure chamber 65 because of a refrigerant liquid introduced into the first compressing chamber 31 in an initial operation of the compressor, a refrigerant gas of the first pressure chamber 45 flows into the second pressure chamber 65 through the pressure adjustment channel 81, thereby lowering a pressure of the first pressure chamber 45 down to that of the second pressure chamber 65. Such a pressure equalization function is effective to prevent an overload on the compressor and ensure a smooth starting thereof. Further, this eliminates a risk of friction between the first vane 35 and the first roller 34, which is conventionally incurred as the first vane 35 presses the first roller 34 excessively due to an abrupt pressure rising in the first pressure chamber 45.

Referring to FIG. 1 again, the multi-stage rotary compressor consistent with the present invention includes an oil supply channel 24 defined in the rotary shaft 21 to enable oil of the oil sump 47 in the bottom region of the hermetic casing 10 to be supplied to frictional portions of the first and second compressing units 30 and 50 as a lubricant. A channel 85 is provided between the second pressure chamber 65 in the upper region of the hermetic casing 10 and the oil sump 47, in order to equalize the pressure of the oil sump 47 with the pressure of the second pressure chamber 65. As shown in FIGS. 1 to 3, the channel 85 is formed of a pipe extending successively through the first cylinder body 32, the first partition 70, the second cylinder body 52, the first pressure chamber 45 and the second partition 71. In this case, the channel 85 does not communicate between the first pressure chamber 45 and the oil sump 47.

By the use of the channel 85, the interior pressure of the oil sump 47 is able to be kept at the same high pressure as that of the second pressure chamber 65, thus permitting the oil to be smoothly supplied to the second compressing unit 50 having the same pressure as that of the oil sump 47 as well as the first compressing unit 30 having the pressure lower than that of the oil sump 47.

Hereinafter, the general operation of the multi-stage rotary compressor configured as stated above will be explained.

If the first and second compressing units 30 and 50 drive by power of the motor driving device 20, a refrigerant is suctioned into the first suction port 38 via the refrigerant suction pipe 11 and is primarily compressed while passing through the first compression chamber 31. The compressed refrigerant is discharged into the first pressure chamber 45 through the first discharge port 39 and the first discharge chamber 40. Thereby, the first pressure chamber 45 is kept at a discharge pressure of the first compressing unit 30.

Then, the refrigerant, inside the first pressure chamber 45, is suctioned to the second compressing unit 50 via the connection pipe 13 and is secondarily compressed to a higher pressure while passing through the second compression chamber 51. After that, the refrigerant is discharged into the second pressure chamber 65 in the upper region of the hermetic casing 10 through the second discharge port 59 and the second discharge chamber 60. Thereby, the second pressure chamber 65 is kept at a discharge pressure of the second compressing unit 50 that is higher than the pressure of the first pressure chamber 45, and the refrigerant is finally discharged from the second pressure chamber 65 to the outside via the discharge pipe 12 at the upper surface of the hermetic casing 10.

During the compressing operation as stated above, a pressure difference between the interior of the first compression chamber 31 and the first pressure chamber 45 outside the first compressing unit 30 is not large to thereby prevent the first vane 31 from excessively pressing the outer circumference of the first roller 34. Similarly, a pressure difference between the interior of the second compression chamber 51 and the second pressure chamber 65 outside the second compressing unit 50 is not large to thereby prevent the second vane 55 from excessively pressing the outer circumference of the second roller 54. Therefore, the compressor of the present invention has an advantage of a reduced driving load of the rotary shaft 21 as compared to a prior art compressor.

In the case of the oil sump 47, because the interior pressure thereof is kept at the same high pressure as that of the second pressure chamber 65, the oil stored in the oil sump 47 is able to be smoothly supplied to the first and second compressing units 30 and 50.

With the present invention, even if a refrigerant liquid enters the first compression chamber 31 in an initial operation of the compressor to cause an abrupt pressure rising of the first compressing unit 30 above the preset pressure and thus the pressure of the first pressure chamber 45 becomes higher than that of the second pressure chamber 65, it is easy to lower the pressure of the first pressure chamber 45 by discharging a refrigerant gas of the first pressure chamber 45 into the second pressure chamber 65 through the pressure adjustment channel 81. As a result, there exists no overload in the initial operation of the compressor, and a smooth starting of the compressor is possible.

As apparent from the above description, the present invention provides a multi-stage rotary compressor configured in such a manner that the interior space of a hermetic casing is divided into a first pressure chamber surrounding a first compressing unit and a second pressure chamber surrounding a second compressing unit. Such a configuration is effective to reduce pressure differences between the inside and outside of the first compressing unit and between the inside and outside of the second compressing unit, thereby achieving less friction between a first vane and a first roller and between a second vane and a second roller. As a result, the present invention can achieve a reduced driving load and an enhanced durability, as compared to a prior art multi-stage rotary compressor.

Further, the present invention is intended to discharge a refrigerant gas from the first pressure chamber into the second pressure chamber through a pressure adjustment channel when a pressure of the first compressing unit rises abruptly, enabling a pressure reduction of the first pressure chamber. This has the effect of preventing an excessive pressure rising of the first compressing unit, eliminating a malfunction risk of the compressor.

Furthermore, according to the present invention, an interior pressure of an oil sump is kept at a pressure of the second pressure chamber that is higher than that of the first pressure chamber, thereby enabling a smooth oil supply from the oil sump to the first and second compressing units.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A multi-stage rotary compressor comprising first and second compressing units mounted in a hermetic casing to compress a gas, the gas being primarily compressed in the first compressing unit and secondarily compressed in the second compressing unit, wherein the interior of the hermetic casing is divided into a plurality of spaces including first and second pressure chambers, the first pressure chamber surrounding the first compressing unit and being kept at a discharge pressure of the first compressing unit, the second pressure chamber surrounding the second compressing unit and being kept at a discharge pressure of the second compressing unit, the first compressing unit includes a first cylinder body defining a first compression chamber, a first roller that eccentrically rotates in the first compression chamber to compress the gas, and a first vane that reciprocates in a radial direction of the first compression chamber according to a rotation of the first roller to divide the interior of the first compression chamber into a suction space and a discharge space, the second compressing unit includes a second cylinder body defining a second compression chamber, a second roller that eccentrically rotates in the second compression chamber to compress the gas, and a second vane that reciprocates in a radial direction of the second compression chamber according to a rotation of the second roller to divide the interior of the second compression chamber into a suction space and a discharge space, and the compressor further comprises:

a first partition interposed between the first cylinder body and the second cylinder body in order to separate the first and second compression chambers from each other and to divide the interior of the hermetic casing into the first and second pressure chambers, a second partition disposed under the first compressing unit in order to divide the interior of the hermetic casing into the first pressure chamber and an oil sump under the first pressure chamber, wherein the oil sump communicates with the second pressure chamber via a channel to keep the same pressure as that of the second pressure chamber.

2. The compressor according to claim 1, wherein the first compressing unit is located below the second compressing unit.

3. The compressor according to claim 2, further comprising;

a pressure adjustment channel formed through the first partition in order to communicate the first pressure chamber with the second pressure chamber; and a pressure adjustment valve provided at the pressure adjustment channel to open the pressure adjustment channel when a pressure of the first pressure chamber is more than a preset pressure to allow the gas to flow from the first pressure chamber to the second pressure chamber and to close the pressure adjustment channel when the pressure of the first pressure chamber is less than the preset pressure.

4. The compressor according to claim 3, wherein the pressure adjustment valve is a reed valve to close an outlet of the pressure adjustment channel at the side of the second pressure chamber.

5. The compressor according to claim 1, further comprising:

a pressure adjustment channel between the first and second pressure chambers for the communication therebetween; and a pressure adjustment valve to open the pressure adjustment channel when a pressure of the first pressure chamber is more than a preset pressure to allow the gas to flow from the first pressure chamber to the second pressure chamber and to close the pressure adjustment channel when the pressure of the first pressure chamber is less than the preset pressure.

6. The compressor according to claim 1, wherein the first vane is exposed to the first pressure chamber to be pressed by the pressure of the first pressure chamber, and the second vane is exposed to the second pressure chamber to be pressed by the pressure of the second pressure chamber.

7. The compressor according to claim 1, further comprising:

a connection pipe provided at the outside of the hermetic casing to deliver the gas from the first pressure chamber to a suction port of the second compressing unit.

* * * * *

UNITED STATES PATENT AND TRADEMARK OFFICE

CERTIFICATE OF CORRECTION

PATENT NO. : 7,377,755 B2
APPLICATION NO. : 11/187882
DATED : May 27, 2008
INVENTOR(S) : Sung Oug Cho It is certified that error appears in the above-identified patent and that said Letters Patent is hereby corrected as shown below:

Column 9, Line 13-14, change “comprising;” to --comprising:--.

Signed and Sealed this

Thirtieth Day of September, 2008

JON W. DUDAS
*Director of the United States Patent and Trademark Office*